US007740545B2

(12) United States Patent
Cameron

(10) Patent No.: US 7,740,545 B2
(45) Date of Patent: Jun. 22, 2010

(54) CURVED GOLF PUTTER

(75) Inventor: Don T. Cameron, Carlsbad, CA (US)

(73) Assignee: Acushnet Company, Fairhaven, MA (US)

( * ) Notice: Subject to any disclaimer, the term of this patent is extended or adjusted under 35 U.S.C. 154(b) by 229 days.

(21) Appl. No.: 11/324,218

(22) Filed: Jan. 4, 2006

(65) Prior Publication Data

US 2007/0155524 A1 Jul. 5, 2007

(51) Int. Cl.
*A63B 53/04* (2006.01)

(52) U.S. Cl. ..... 473/340; 473/349

(58) Field of Classification Search ..... 473/324–350
See application file for complete search history.

(56) References Cited

U.S. PATENT DOCUMENTS

| | | | | |
|---|---|---|---|---|
| 1,537,320 | A | 5/1925 | Marsh | |
| 1,660,126 | A | 2/1928 | Heeter | |
| D89,332 | S | 2/1933 | Bartsch | |
| D182,485 | S | 4/1958 | Sprinkel | |
| 2,842,369 | A | 7/1958 | East | |
| 2,859,972 | A | 11/1958 | Reach | |
| 2,934,347 | A | 4/1960 | Sinischaichi | |
| D196,736 | S | 10/1963 | De Carlo | |
| 3,333,854 | A | 8/1967 | White | |
| D217,373 | S | 4/1970 | Zitko | |
| 3,680,860 | A | 8/1972 | Elkins, Jr. | |
| D228,003 | S | 7/1973 | Warner | |
| 3,884,477 | A | 5/1975 | Bianco | |
| 3,888,484 | A | 6/1975 | Zitko | |
| 3,955,819 | A | 5/1976 | Yokich | |
| D240,947 | S * | 8/1976 | Pomper | D21/735 |
| D245,437 | S | 8/1977 | Thiel | |
| D251,027 | S | 2/1979 | Cruger | |
| 4,174,839 | A | 11/1979 | Marrs | |
| D264,367 | S | 5/1982 | Gida | |
| 4,795,157 | A | 1/1989 | Bencriscutto | |
| 4,805,922 | A | 2/1989 | Whitfield | |
| 4,861,038 | A | 8/1989 | Fucinato | |
| 4,872,684 | A | 10/1989 | Dippel | |
| 4,913,438 | A | 4/1990 | Anderson | |
| D317,035 | S | 5/1991 | Pelz | |
| D317,490 | S | 6/1991 | Pelz | |
| 5,072,941 | A | 12/1991 | Klein | |
| 5,080,365 | A | 1/1992 | Winchell | |
| D323,688 | S | 2/1992 | Whitney | |

(Continued)

FOREIGN PATENT DOCUMENTS

| | | |
|---|---|---|
| EP | 0 608 193 A | 7/1994 |

(Continued)

*Primary Examiner*—Alvin A Hunter
(74) *Attorney, Agent, or Firm*—Hanify & King, P.C.

(57) ABSTRACT

A golf putter with a having a curved body and a high toe design is disclosed and claimed. The putter head includes a face member, which has a heel and a toe, and a body member. The body member is connected to and extends rearward from the face member. At least a portion of the body member is curved toward the heel of the club head. The face member preferably is angled such that the toe has a greater height than the heel. The body member may be similarly angled. The body member extends through the face member and forms at least a portion of a striking face of the club head.

23 Claims, 7 Drawing Sheets

U.S. PATENT DOCUMENTS

| | | | | |
|---|---|---|---|---|
| D324,250 | S | 2/1992 | Magness | |
| D354,535 | S | 1/1995 | Queen | |
| D355,944 | S | 2/1995 | Bendo | |
| 5,470,070 | A | 11/1995 | Bendo | |
| D368,292 | S | 3/1996 | Willoughby | |
| D381,383 | S | 7/1997 | Brett | |
| D385,321 | S | 10/1997 | Quattrochi | |
| 5,692,969 | A | 12/1997 | Schooler | |
| 5,700,207 | A | 12/1997 | Guthrie et al. | |
| 5,746,664 | A | 5/1998 | Reynolds, Jr. | |
| D395,692 | S | 6/1998 | Butler | |
| 5,890,969 | A | 4/1999 | Bechler | |
| D410,055 | S | 5/1999 | Loop | |
| D410,716 | S | 6/1999 | Bendo et al. | |
| 5,984,800 | A | 11/1999 | Uebelhor | |
| D422,328 | S | 4/2000 | Lannoch | |
| 6,045,453 | A | 4/2000 | Jenkins | |
| 6,056,647 | A * | 5/2000 | Tingelstad | 473/307 |
| D448,437 | S | 9/2001 | Colucci | |
| D454,933 | S | 3/2002 | Shenoha | |
| D455,467 | S | 4/2002 | Shenoha | |
| 6,409,610 | B1 | 6/2002 | Ahn et al. | |
| 6,435,979 | B1 * | 8/2002 | Mounfield, Jr. | 473/324 |
| D465,819 | S | 11/2002 | Bussiere | |
| D477,041 | S | 7/2003 | Cameron | |
| D479,291 | S | 9/2003 | Murray | |
| D481,431 | S | 10/2003 | Wightman | |
| D483,824 | S | 12/2003 | Tang et al. | |
| D486,540 | S | 2/2004 | Bettinardi | |
| D486,541 | S | 2/2004 | Bettinardi | |
| D494,236 | S | 8/2004 | Shmoldas et al. | |
| D494,237 | S | 8/2004 | Ware | |
| D497,401 | S | 10/2004 | Zimmerman | |
| D497,402 | S | 10/2004 | Moore | |
| D500,539 | S | 1/2005 | Holloway | |
| D502,518 | S | 3/2005 | Smart | |
| D503,445 | S | 3/2005 | Toroussian | |
| D503,446 | S | 3/2005 | Toroussian | |
| D503,447 | S | 3/2005 | Toroussian | |
| D507,613 | S * | 7/2005 | Baiocchi | D21/742 |
| D509,865 | S | 9/2005 | Blancher | |
| 6,958,019 | B2 | 10/2005 | Rohrer | |
| 7,077,757 | B1 | 7/2006 | Payne et al. | |
| 2005/0049076 | A1 * | 3/2005 | Schweigert et al. | 473/340 |
| 2005/0049078 | A1 | 3/2005 | Yamanaka et al. | |
| 2005/0187028 | A1 | 8/2005 | Chang et al. | |
| 2005/0239574 | A1 | 10/2005 | Rohrer | |
| 2006/0052178 | A1 * | 3/2006 | Franklin et al. | 473/340 |
| 2006/0058113 | A1 * | 3/2006 | Hasegawa | 473/340 |

FOREIGN PATENT DOCUMENTS

| | | | |
|---|---|---|---|
| GB | 2 371 235 | A | 7/2002 |
| GB | 2 405 352 | A | 3/2005 |
| JP | 59-169867 | | 11/1984 |
| JP | 8-510660 | | 11/1996 |
| JP | 10137374 | A * | 5/1998 |
| JP | 3053054 | | 7/1998 |
| JP | 2002-85605 | | 3/2002 |
| JP | 2003-102880 | | 4/2003 |
| JP | 2003-102882 | | 4/2003 |
| JP | 2004-264361 | | 9/2004 |
| JP | 2004-321761 | | 11/2004 |

* cited by examiner

CURVED GOLF PUTTER

BACKGROUND OF THE INVENTION

1. Field of the Invention

The present invention relates to a golf club, and, more particularly, the present invention relates to a golf putter having a curved body and a high toe.

2. Description of the Related Art

Golf club heads come in many different forms and makes, such as wood- or metal-type, iron-type (including wedge-type club heads), utility- or hybrid- or specialty-type, and putter-type. Each of these styles has a prescribed function and make-up. The present invention primarily relates to putters, which typically are used to strike a golf ball and impart to it a rolling travel path.

There are many styles of putters, including blades, mallets, heel-toe weighted, and T-line putters. Different types of putters provide different advantages. For example, T-line putters typically have a body member extending rearward from the face. This helps the golfer visualize the intended line of the putt, and may provide improved mechanical attributes. Furthermore, known putters have a generally constant height along the length of the face (sole to top line). However, there are no known putters that provide a curved body member or a high toe.

SUMMARY OF THE INVENTION

The present invention relates to a golf putter with a having a curved body and a high toe design. The putter head includes a face member, which has a heel and a toe, and a body member. The body member is connected to and extends rearward from the face member. At least a portion of the body member is curved toward the heel of the club head. The body member may include a straight portion that is not curved, the straight portion preferably extending immediately rearward of the face member a distance from 0.5 to 3 inches, which transitions into a curved portion. Alternatively, the entirety of the body member extending rearward of the face member is curved. The body member extends through the face member and forms at least a portion of a striking face of the club head.

The curved portion of the body member may be quantified in a variety of manners. One such manner is via the radius of curvature, which preferably is from 0.5 inch to 10 inches. Another such manner is via the angle formed between a first line perpendicular to the face member and a second line tangent to the curved body member portion at a rear-most end of the body member. This body member angle preferably is from 1° to 10°. The curved body portion may be curved uniformly such that there is only one radius of curvature, or the curved body portion may contain a complex curve pattern such that there are multiple radii of curvature.

The face member preferably is angled such that the toe has a greater height than the heel. The angle formed by the top surface of the face member and a horizontal plane at the normal address position preferably is from 1° to 10°. The body member may preferably be angled similarly. These angles are preferably within one-half degree of each other, within one-half degree of the face member angle, and within one-half degree of the club head loft angle.

The body member preferably is tapered at an angle within one-half degree of the face member angle. This tapering may be along the top surface such that the body member has a greater height towards the toe than it does towards the heel, at a lower, rear portion of the body member, or both.

The golf club contains a shaft, which may be connected to the club head via a hosel. The hosel may be angled relative the top surface of the face member such that it is angled relative the face member within one-half degree of the loft angle, the body member angle, and/or the face member angle.

The face member preferably is formed of a stainless steel, and the body member preferably is formed of aluminum or an aluminum alloy. To achieve desirably playing characteristics, the club head may contain weight modifying attributes. For example, the face member may contain weight-reducing recesses therein, and the body member may contain weight-reducing holes passing at least partially therethrough. Weight members may be included in the face member, the body member, or both. Such cavities, holes, and weight members allow the club head designer to achieve the desired overall club head weight, as well as desired moments of inertia and center of gravity locations.

DESCRIPTION OF THE DRAWINGS

The present invention is described with reference to the accompanying drawings, in which like reference characters reference like elements, and wherein.

DETAILED DESCRIPTION OF THE INVENTION

Other than in the operating examples, or unless otherwise expressly specified, all of the numerical ranges, amounts, values, and percentages may be read as if prefaced by the word "about" even though the term "about" may not expressly appear with the value, amount, or range. Accordingly, unless indicated to the contrary, the numerical parameters set forth in the following description and claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in any specific examples are reported as precisely as possible. Any numerical value, however, inherently contains certain errors necessarily resulting from the standard deviation found in their respective testing measurements. Furthermore, when numerical ranges of varying scope are set forth herein, it is contemplated that any combination of these values inclusive of the recited values may be used.

Figure 1:
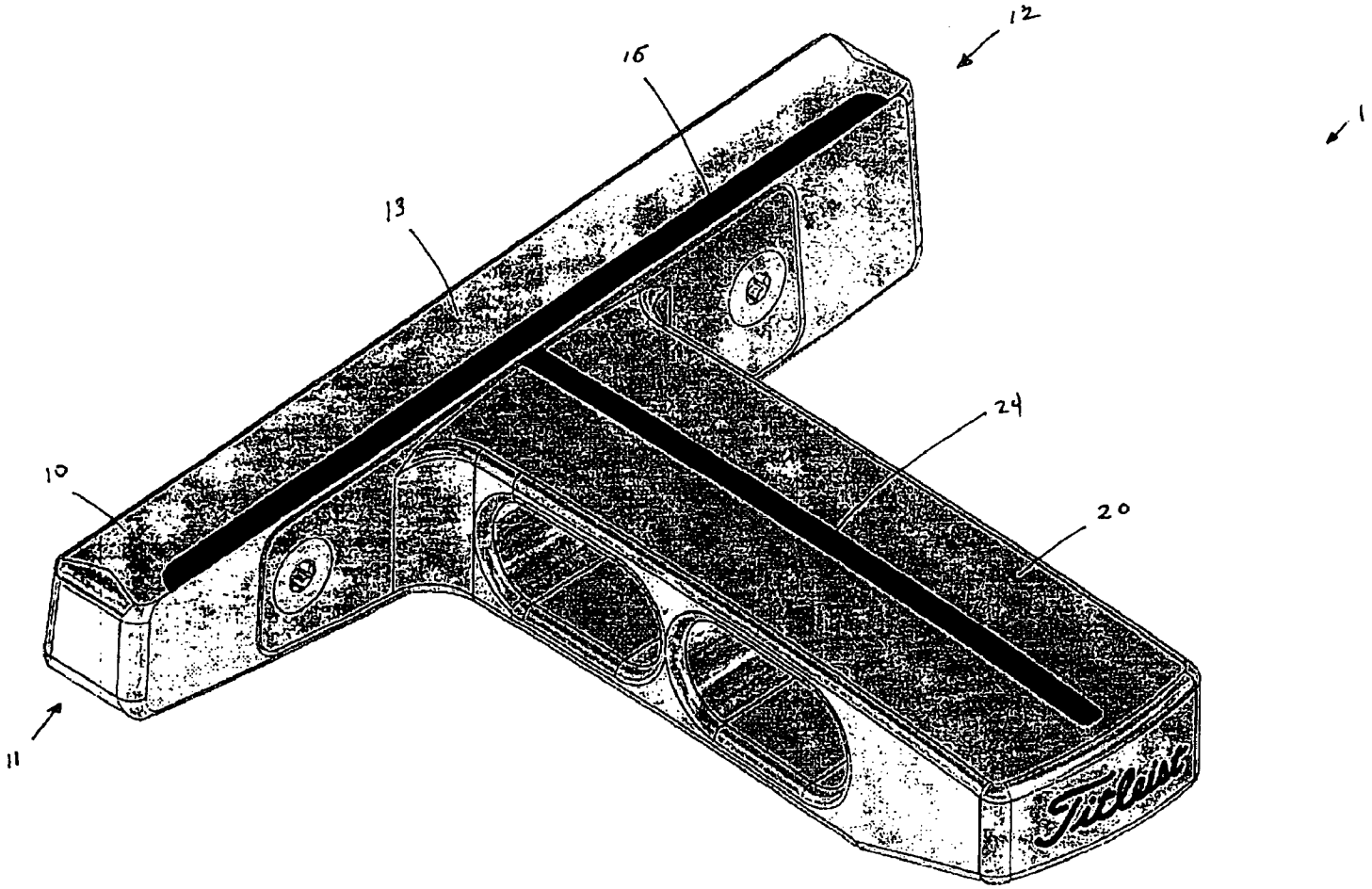
FIG. 1 shows a top perspective view of a golf club head of the present invention.
Figure 2:
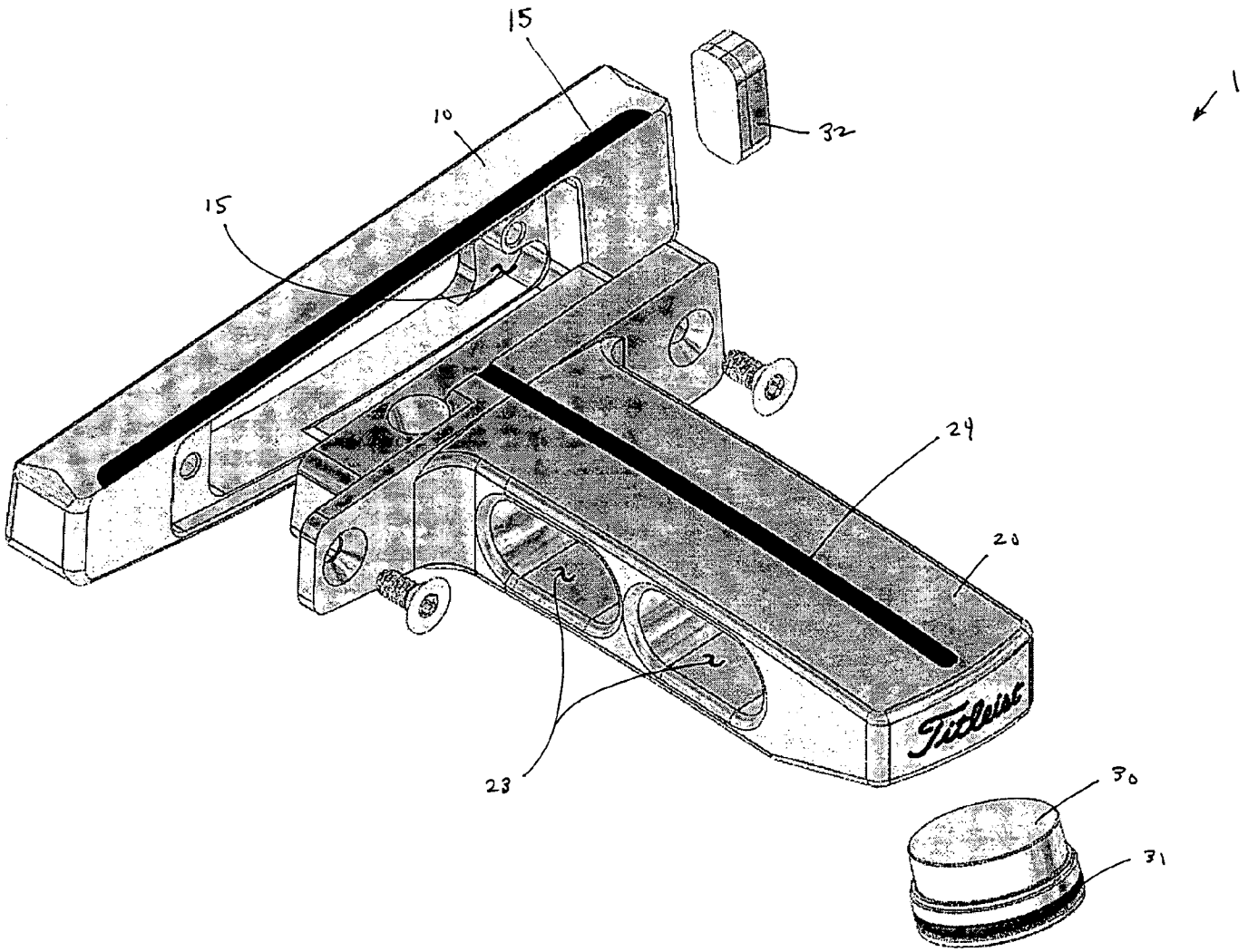
FIG. 2 shows an exploded view of the golf club head of FIG. 1.
Figure 3:
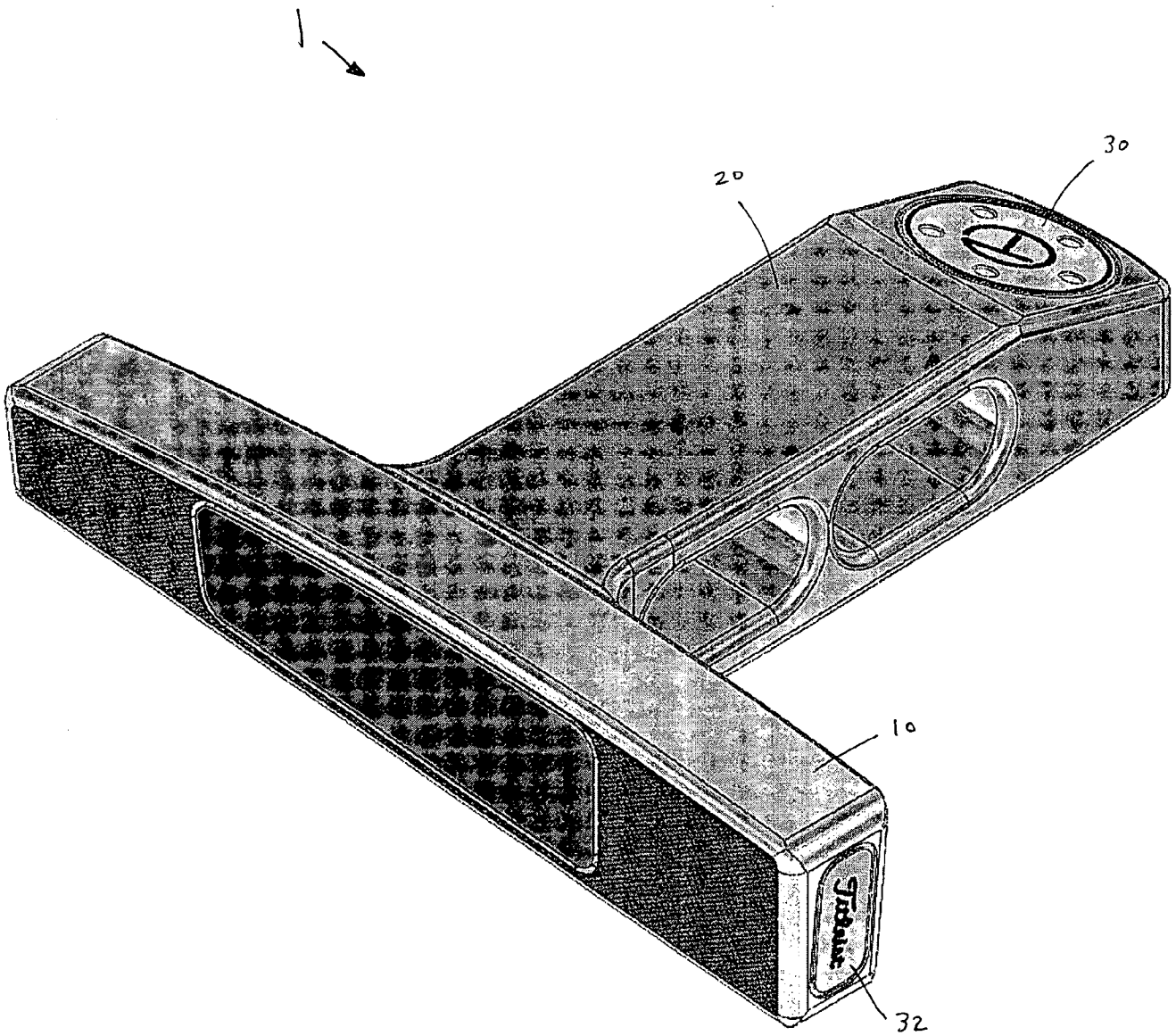
FIG. 3 shows a bottom perspective view of the golf club head of FIG. 1.
Figure 4:
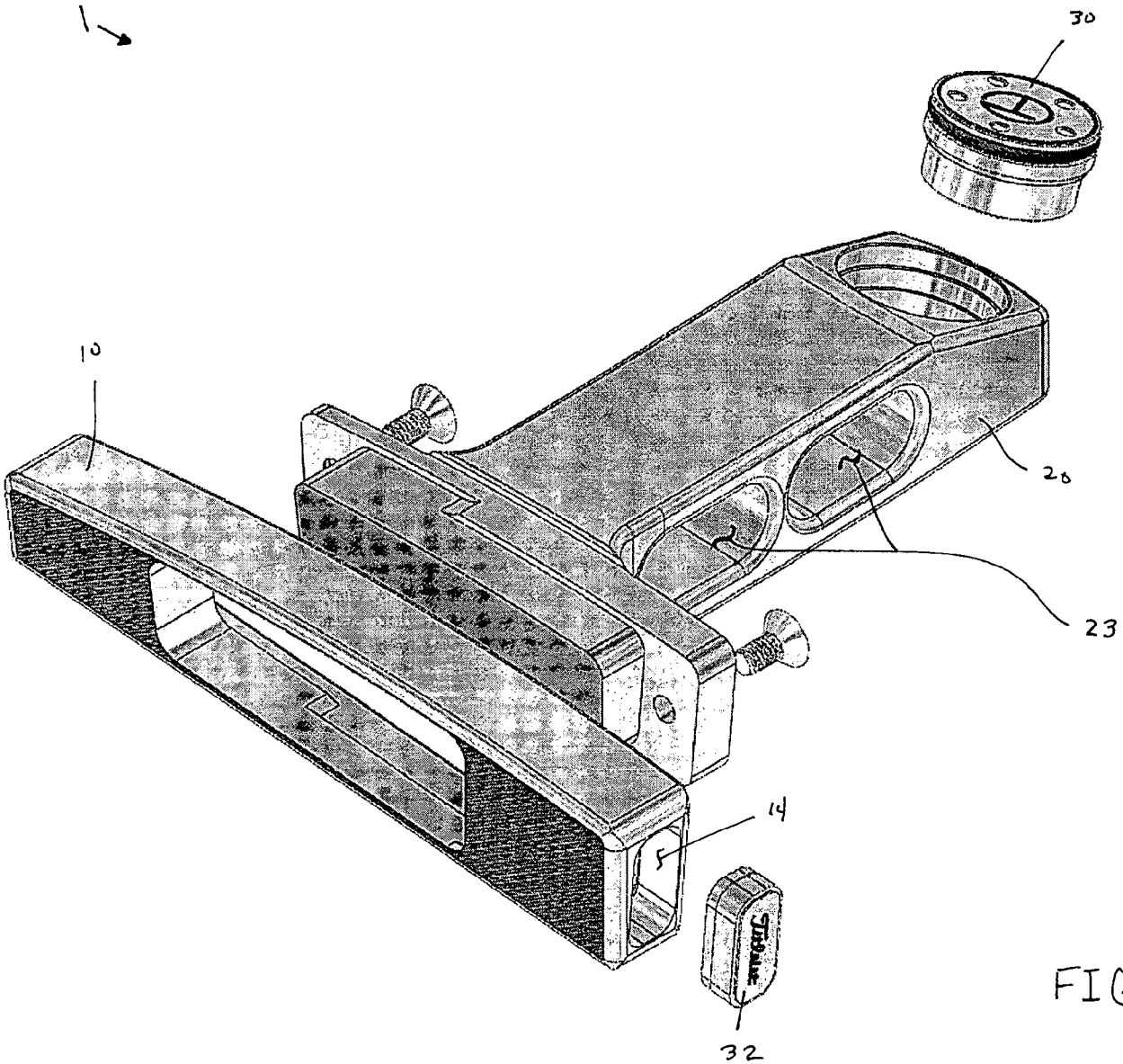
FIG. 4 shows an exploded view of the golf club head of FIG. 3.
Figure 5:
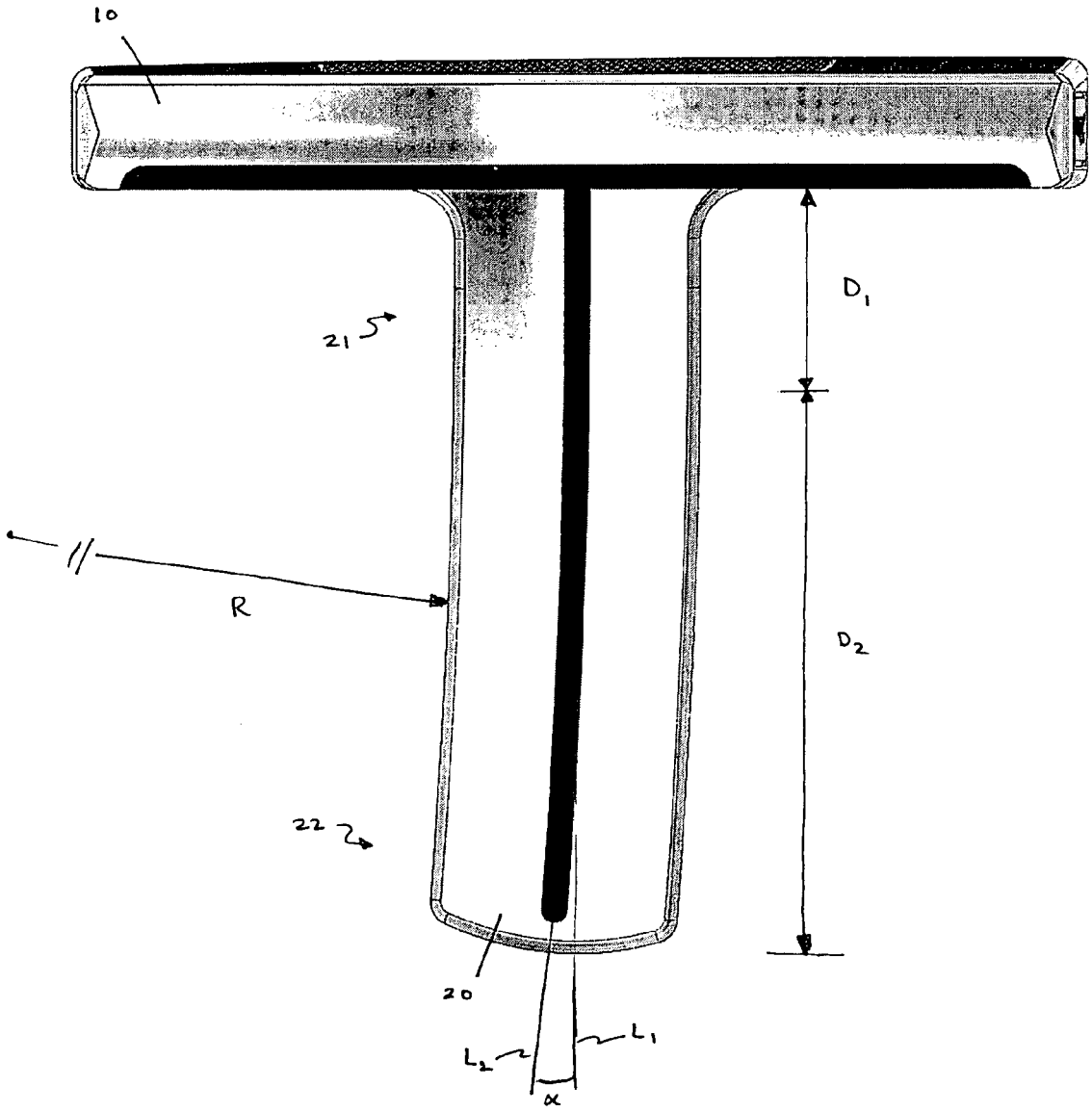
FIG. 5 shows a top view of the golf club head of FIG. 1.

FIGS. 1 and 3 show top and bottom perspective views, respectively, of a golf club head 1 of the present invention, and FIGS. 2 and 4 show exploded views thereof, respectively. The club head 1 includes two main components: a face member 10 and a body member 20. The face member 10 and body member 20 are connected such that the body member 20 extends rearward from the face member 10. As seen in FIG. 5, the body member 20 is curved toward the heel 11 of the club head 1. This provides an alignment tool for the golfer to use the proper swing path. The putting stroke, like other golf strokes, should pivot about the golfer's body. The arc of the swing is dictated by the club lie angle (the angle between the shaft and the club head); the flatter the lie, the greater the swing path arc. The curved nature of the body member 20 encourages the golfer to use the correct swing path.

The curved body member 20 may be quantified in a variety of manners. For example, the body member may have a radius of curvature R, which may be from 0.5 inch to 10 inches, with 3 to 7 inches being more preferred. Alternatively, or additionally, the body member curvature can be described by the angle $\alpha$ formed between a first line $L_1$, which is perpendicular to the face member 10, and a second line $L_2$, which is tangent to the curved body member 20. The lines $L_1$, $L_2$ may be positioned in a variety of locations. In the illustrated embodiment, the first line $L_1$ passes through a center point of the body member 20 at the rear-most portion of its junction with the face member 10, and the second line $L_2$ is tangent to the body member 10 at a rear-most end of the body member 20. The body member angle $\alpha$ formed by the lines $L_1$, $L_2$ may be from 1° to 10°, with 3° to 7° being more preferred. This amount of curvature encourages the golfer to putt along a proper swing path while maintaining a pleasing and beneficial aesthetic appearance to the club head 1. Where one of these exemplary manners of quantifying the body member curvature is used herein, the skilled artisan will recognize that the other exemplary manner, as well as additional manners, may equally be used.

At least a portion of the body member 20 is curved toward the heel 11. That is, the body member 20 may contain a straight portion 21 in addition to a curved portion 22. The straight portion 21, which is not curved, preferably extends immediately rearward of the face member 10. At some point along the body member 20 rearward of the face member 10, the straight portion 21 transitions into the curved portion 22, which exhibits the traits discussed above. Preferably, the remainder of the body member 20 is curved. That is, preferably the entirety of the body member 20 extending rearward of the face member 10 is formed by the union of the straight portion 21 and the curved portion 22. The distance $D_1$ that the straight portion 21 extends rearward from the face member 10 preferably may be from 0.5 to 3 inches. The distance $D_2$ that the curved portion 22 extends beyond the straight portion 21 is a function of the overall length of the body member 20, and preferably may be from 2 to 4.5 inches. The overall length of the body member 20 extending rearward from the face member 10 may preferably be from 2 to 5 inches. It should be noted that a skilled golf club designer, in keeping with the benefits disclosed herein, may choose alternate dimensions than those presented above.

Figure 7:
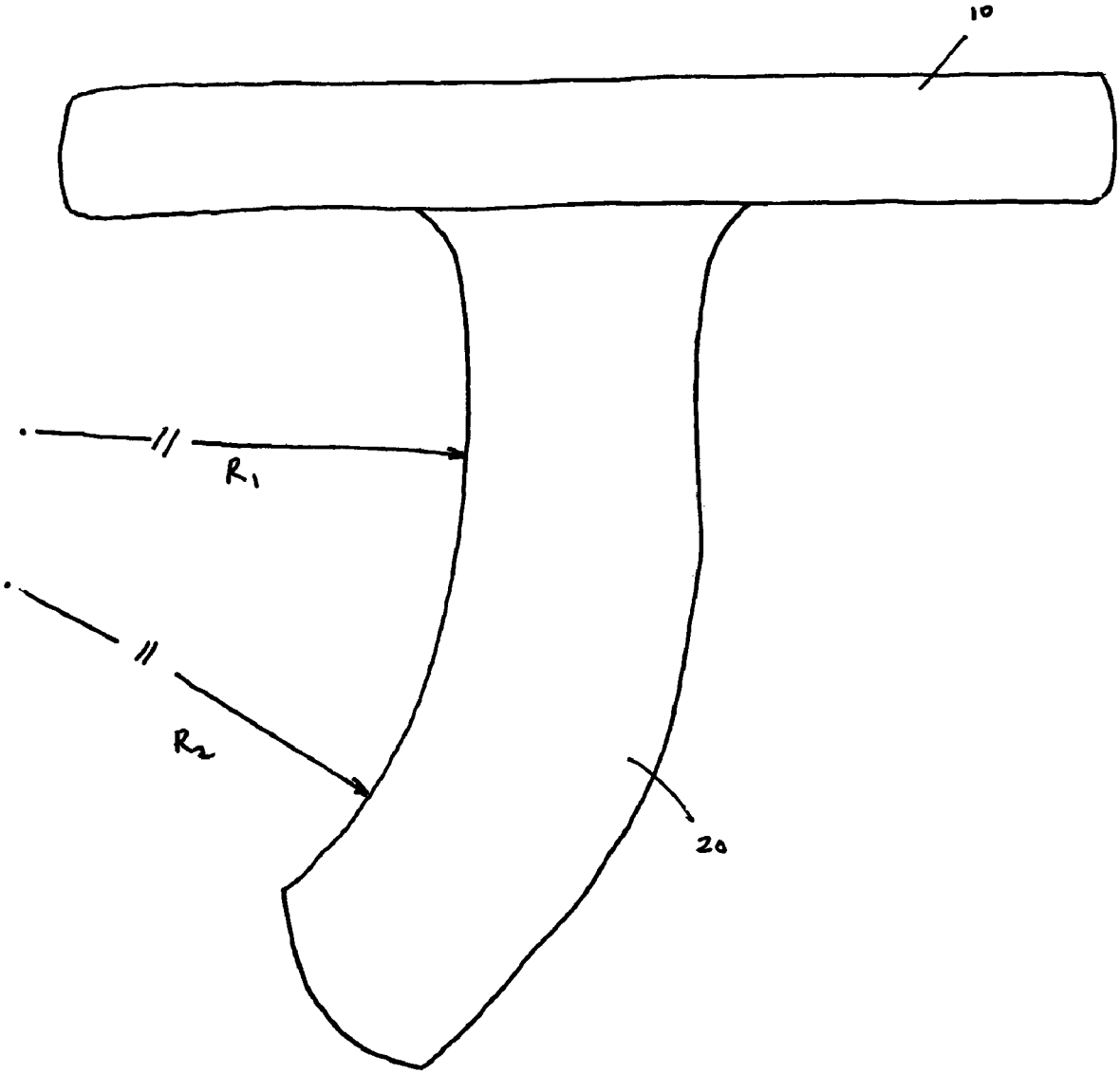
FIG. 7 shows a top view of a golf club head of the present invention.

Alternatively, all of the body member 20 extending rearward from the face member 10 may be curved. In other words, the distance D1 that the straight portion 21 extends rearward from the face member 10 may be from 0 to 3 inches. The curvature of the body member 20, whether it be all or only a portion of the overall body member length, preferably has a constant curvature. That is, the curved portion 22 of the body member 20, which may extend along the entire length of the body member 20 rearward from the face member 10, has a constant radius of curvature R. This helps present an aesthetically pleasing, flowing look to the club head 1. Alternate embodiments, however, may include a body member 20 having multiple radii of curvature along the curved body member portion 22. As one example, a first region of the curved portion 22 nearest the face member 10 may have a greater radius of curvature than a second region of the curved portion 22 further away from the face member 10. See, for example, FIG. 7, which shows a top view of a golf club head with a body member 20 having a first radius of curvature $R_1$ and a second radius of curvature $R_2$.

Figure 6:
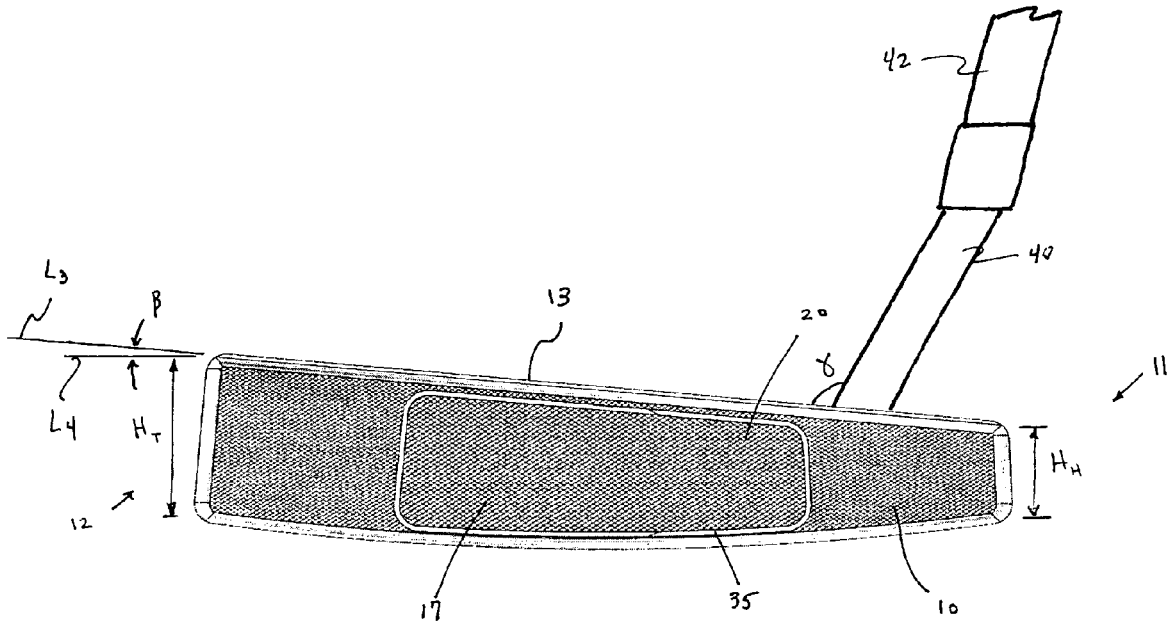
FIG. 6 shows a front view of the golf club head of FIG. 1.

While known putters have a generally constant height along the length of the face (sole to top line), most iron-type golf clubs have an angled top line such that the toe height is greater than the heel height. This disparity may likely cause a golfer to raise the toe of the putter to achieve a similar look at address with the putter as with the irons. This toe elevation, however, causes the putt line of the putt to actually be aimed left of the target (for a right-handed golfer; the putt line would be aimed right of the target for a left-handed golfer). This phenomenon is a result of the putter's loft angle. To alleviate this misalignment, one embodiment of the present invention provides a putter-type golf club head 1 with a face member 10 having a top surface 13 that is angled. As shown in FIG. 6, the face member 10 includes a top or upper surface 13 that is angled such that the height $H_T$ at the toe 12 is greater than the height $H_H$ at the heel 11. Because the angled nature of the face member 10 causes the putter toe 12 to have a similar appearance to an iron-type golf club head, the golfer is less likely to raise the toe at address. Thus, the resulting putt is more true and more likely to achieve the desired result. The overall length of the face member 10, in a heel-to-toe direction may preferably be from 2 to 5 inches.

As shown in FIG. 6, line $L_3$ shows an extension of the surface 13 and line $L_4$ represents a horizontal plane (with the club head 1 being in the address position). These lines $L_3$, $L_4$ form a face member angle $\beta$, which may be from 1° to 10°, with 3° to 7° being more preferred. In one embodiment, the face member angle $\beta$ is matched to the putter head loft angle such that it is within (plus/minus) one-half degree of the loft angle (that is, the angle formed between the striking face of the club head and a vertical plane at address). The body member angle $\alpha$ and face member angle $\beta$ may be matched such that they are within one-half degree of each other, and, optionally, within one-half degree of the loft angle. This angle matching results in a club head having a flowing, aesthetically pleasing shape and appearance.

As shown most clearly in FIG. 6, the body member 20 may also be angled or tapered similarly to the face member 10. That is, the top surface of the body member 20 may be angled such that the toe side has a greater height than the heel side. Preferably, the body member 20 is angled at the same angle as the face member 10 (face member angle $\beta$). A lower, rear portion of the body member 20 may also be tapered. For example, and as shown in the drawing figures, the lower, rear portion of the body member 20 may be tapered or angled upward towards the top surface of the body member in a direction away from the face member 10 (that is, the horizontal component of the taper angle preferably is substantially perpendicular to the face member 10). Each of these body member taper angles preferably is from 1° to 10°, and may be within one-half degree of the loft angle, the body member angle $\alpha$, and/or the face member angle $\beta$.

A preferred material for the face member 10 includes stainless steel, such as 8802 stainless steel, and preferred materials for the body member 20 include aluminum or aluminum alloy. To achieve desired moment of inertia (MOI) characteristics, weight members may included with the body member and/or 20 face member 10. For example, a weight member 30 may be positioned in a rear portion of the body member 20.

One preferred location is the lower side of the face member 20 in the tapered area mentioned above. The weight member 30 may have a mass from 5 to 30 grams. Preferably, a plurality of weight members 30 having varying masses are provided and a specific weight member 30 chosen therefrom depending on the particular golfer's needs. For example, weight members 30 having masses differing by 5 grams or 10 grams may be provided, and the appropriate mass for a particular golfer selected by the club designer or club fitter. In this manner, the club head 1 (and resulting golf club) can be tailored to a golfer's individual needs. The particular weight member 30 used is attached in known manner, and preferably such that it is not readily adjustable during use. A gasket or o-ring 31 may be provided with the weight member 30 to ensure a solid feel to the club head 1. Similarly, one or more weight members 32 may be included with the face member 10.

More material is inherently present in the toe 12 due to the tapered nature of the face member 10. For the same reason, the club head 1 center of gravity is biased towards the toe 12, which may provide golfers with a similar feel to an iron-type club and further encourage the proper swing plane and path. As a means of controlling the overall weight/mass of the club head 1, weight adjustments may be incorporated into the design of the club head. For example, material may be removed from the toe 12, forming a weight-reducing recess 14. The weight member 32 is positioned within at least a portion of the recess 14. To further achieve these weight constraints, the weight member 32 may take the form of a low-mass insert rather than a weight. In this case, the mass of the face member 10 itself provides the desired MOI. Another exemplary weight reduction means includes removal of material from the inner surfaces of the face member 10 at the junction with the body member 20. Thus, a weight reducing recess 15 is seen in FIG. 2. It should be noted that enough material is provided in the face member 10 to ensure a proper connection between the face member 10 and the body member 20.

To further ensure the appropriate overall club head weight is achieved, weight reducing holes 23 may be provided in the body member 20. These holes 23 may pass entirely through the body member 20, or only partly through the body member 20 such that they form cavities. In the latter case, a pair or pairs of mirrored cavities are provided on either side of the body member 20. Two such holes (or cavity pairs) 23 are shown in the illustrated embodiments. More or fewer holes 23 may also be used. The number of holes 23 may be a function of the putter type. For example, two such holes 23 may be provided with a standard putter, one such hole 23 for a belly putter, and no such holes 23 for a long putter. The weight members 30, 32 may also be chosen based at least in part on the putter type.

The club head 1 may include indicia to further encourage a proper swing and desired resulting golf shot. For example, a sight or aiming line 16 may be provided in or along the top surface 13. In the illustrated embodiments, aiming line 16 extends in the heel-to-toe direction and is substantially perpendicular to the intended path of the putt. This helps the golfer visualize and achieve the desired result. As an additional example, a swing path line 24 may be provided in or along the top surface of the body member 20. The swing path line 24, which helps the golfer visualize and achieve the proper swing plane and path, preferably is positioned in the center of the body member 20. While these indicia 16, 24 are illustrated in the figures as thickened, dark lines, the skilled artisan will realize that the indicia 16, 24 may take a variety of other forms. For example, the indicia may be thinner lines, different colors, dots instead of lines, etc.

The body member 20 may extend through the face member 10 to form at least a portion of the club head striking face or surface 17. As shown, for example, in FIG. 6, the body member 20 is coupled to the face member 10 such that its forward-most portion is flush with the forward-most portion of the face member 10, cooperatively forming the striking face 17. This helps ensure a solid feel to the putter and a desirable resulting putt. A layer of 35 vibration damping material may be positioned between the face member 10 and the body member 20 in the region of the striking face 17. This layer 35 may take the form of an adhesive or epoxy that is used to couple the face member 10 and the body member 20. Alternatively, the layer 35 may be an independent component, such as elastomer, polyurethane, or the like, which is coupled to both the face member 10 and the body member 20.

A hosel 40 and shaft 42 may be attached to the club head, to the face member 10 or the body member 20, in known manner. Such hosel 40 and/or shaft 42 may be attached to the club head 1 in any manner, such as straight, angled, and offset. See U.S. Pat. No. 6,334,818 and U.S. patent application Ser. No. 10/946,394, the disclosures of which are incorporated herein. If an angled hosel 40 is used, it preferably forms an angle $\gamma$ relative the top surface 13 that is within one-half degree of the loft angle, the body member angle $\alpha$, and/or the face member angle $\beta$. The angle of the shaft, which is coupled to the hosel, may be altered as needed. The shaft and/or hosel may be a bore-through design or, alternatively, may not extend completely through to the club head sole.

The club head components are formed in known manner, such as by milling. Other manufacturing methods may also be used. The components are assembled in known manner, such as by mechanical connections, adhesives, or a combination thereof.

While the preferred embodiments of the present invention have been described above, it should be understood that they have been presented by way of example only, and not of limitation. It will be apparent to persons skilled in the relevant art that various changes in form and detail can be made therein without departing from the spirit and scope of the invention. Thus the present invention should not be limited by the above-described exemplary embodiments, but should be defined only in accordance with the following claims and their equivalents. Furthermore, while certain advantages of the invention have been described herein, it is to be understood that not necessarily all such advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other advantages as may be taught or suggested herein.

What is claimed is:

1. A putter-type golf club head, comprising:

a face member having a heel and a toe; and a body member coupled to said face member and comprising:

a straight portion extending rearward from a central portion of said face member intermediate said heel and said toe; and a curved portion extending rearward from said straight portion and curved toward said heel, wherein said curved portion has a radius of curvature from 0.5 inch to 10 inches.

2. The club head of claim 1, wherein said radius of curvature is from 3 to 7 inches.

3. The club head of claim 1, wherein said radius of curvature is constant through the entire curved portion.

4. The club head of claim 1, wherein a first line perpendicular to said face member and a second line tangent to said curved body member portion at a rear-most end of said body member form an angle from 1° to 10°.

5. The club head of claim 4, wherein said angle is from 3° to 7°.

6. The club head of claim 1, wherein said straight portion extends a distance from 0.5 to 3 inches from said face member.

7. The club head of claim 1, wherein an upper surface of said face member is angled such that said toe has a greater height than said heel.

8. The club head of claim 7, wherein said upper surface forms a face member angle relative a horizontal plane at an address position from 1° to 10°.

9. The club head of claim 8, wherein a first line perpendicular to said face member and a second line tangent to said curved body member portion at a rear-most end of said body member form a body member angle that is within one-half degree of said face member angle.

10. The club head of claim 9, wherein the club head contains a loft angle that is within one-half degree of said body member angle and said face member angle.

11. The club head of claim 10, further including a hosel coupled to said face member or said body member, said hosel forming and angle relative said face member that is within one-half degree of said loft angle, said body member angle, and said face member angle.

12. The club head of claim 8, wherein at least a portion of said body member is tapered at an angle within one-half degree of said face member angle.

13. The club head of claim 1, wherein said body member defines weight-reducing holes passing at least partially therethrough.

14. The club head of claim 1, further including a weight member coupled to a rear portion of said body member.

15. The club head of claim 14, wherein said weight member has a mass from 5 to 30 grams.

16. A putter-type golf club head comprising:

a face member having a heel and a toe; and a body member coupled to said face member and comprising:

a straight portion extending rearward from said face member;

a curved portion curved toward said heel and extending rearward from said straight portion, wherein said curved portion comprises multiple radii of curvature, and wherein at least one radii of curvature is from 0.5 inch to 10 inches.

17. The putter-type golf club head of claim 16, wherein an upper surface of said face member is angled such that said toe has a greater height than said heel.

18. A putter-type golf club head comprising:

a face member having a heel and a toe; and a body member coupled to said face member and extending rearward from said face member, at least a portion of said body member being curved toward said heel;

wherein said body member extends through said face member and forms at least a portion of a striking face of the club head.

19. The putter-type golf club head of claim 18, wherein an upper surface of said face member is angled such that said toe has a greater height than said heel.

20. A putter-type club head comprising:

a face member having a heel and a toe, wherein an upper surface of said face member is angled such that said toe has a greater height than said heel; and a body member coupled to said face member and extending rearward from said face member, at least a portion of said body being curved toward the heel;

wherein said face member is formed of stainless steel and said body member is formed of aluminum or an aluminum alloy.

21. A putter-type golf club head comprising:

a face member having a heel and a toe; and a body member coupled to said face member comprising:

a straight portion extending rearward from said face member; and a curved portion, curved toward said heel and extending rearward from said straight portion, wherein said face member includes one or more weight reducing recesses.

22. The putter-type golf club head of claim 21, wherein an upper surface of said face member is angled such that said toe has a greater height than said heel.

23. The putter-type golf club head of claim 21, wherein said curved portion has a radius of curvature from 0.5 inch to 10 inches.

* * * * *